United States Patent [19]

Devic et al.

[11] Patent Number: 4,812,206

[45] Date of Patent: Mar. 14, 1989

[54] PROCESS FOR BLEACHING LIGNOCELLULOSIC MATTER

[75] Inventors: Michel Devic, Sainte Foy Les Lyon; Robert Angelier, Echirolles, both of France

[73] Assignee: Atochem, France

[21] Appl. No.: 99,762

[22] Filed: Sep. 22, 1987

[30] Foreign Application Priority Data

Sep. 23, 1986 [FR] France ..... 86 13546

[51] Int. Cl.[4] ..... D21C 3/26; D21C 3/00

[52] U.S. Cl. ..... 162/19; 162/25; 162/60; 162/78; 162/90; 162/86; 162/89; 162/84

[58] Field of Search ..... 162/25, 78, 60, 19, 162/26, 90, 84, 86, 87, 88, 89, 18, 23, 56, 27

[56] References Cited

FOREIGN PATENT DOCUMENTS 0187477 7/1986 European Pat. Off. .

OTHER PUBLICATIONS

Abstract Bulletin of the Institute of Paper Chemistry, vol. 53, NO. 2, Aug. 1982, p. 260, No. 2296, Appleton, Wisconsin, USA.

*Primary Examiner*—Peter Chin

*Assistant Examiner*—Thi Dang

*Attorney, Agent, or Firm*—Sigalos, Levine & Montgomery

[57] ABSTRACT

A process for bleaching a lignocellulosic matter in the form of a mechanical, thermomechanical, chemicomechanical or chemicothermomechanical papermaking pulp, or of wood chips while being converted into one of these pulp types by processing in a machine consisting essentially of two interpenetrating spiral surfaces wound around parallel shafts driven in synchronous rotation in the same direction inside a barrel which encloses them, and determining between upstream and downstream in the direction of forward travel of the matter a series of zones for drawing and braking the matter, which comprises combining a bleaching treatment using a reducing agent and a bleaching treatment using an oxidizing agent, characterized in that, after pretreatment using at least one metal-complexing or sequestering agent, the lignocellulosic matter undergoes a washing operation with an efficiency greater than 96% before undergoing in succession a bleaching treatment using a reducing agent at a pH of between about 8 and 12, a washing operation to remove the reducing agent and a bleaching treatment using an oxidizing agent.

12 Claims, No Drawings

PROCESS FOR BLEACHING LIGNOCELLULOSIC MATTER

BACKGROUND OF THE INVENTION

The present invention relates to a process for bleaching lignocellulosic matter.

The lignocellulosic matter to which the process of the invention applies denotes in this case the paper pulps of mechanical, thermomechanical, chemicomechanical and chemicothermomechanical origin, as well as wood chips while being converted into one of these pulp types by processing in a machine such as described, for example, in the French patent No. 2,319,737, the French certificate of addition to this patent No. 2,436,844, and the French patent Nos. 2,418,295 and 2,451,963, all in the name of the Creusot-Loire Company.

Lignocellulosic matter of this kind need to be bleached in order that the products into which they are ultimately converted such as, for example, paper intended for printing newspapers and magazines should be of the required quality.

The process of this invention relates more particularly to a process for bleaching this matter, which combines a bleaching treatment using a reducing agent and a bleaching treatment using an oxidizing agent.

It is known to carry out the bleaching treatment using a reducing agent such as sodium hydrosulfite or sodium dithionite which is used as such or generated from sodium borohydride, sodium borohydride itself, thiourea dioxide or formamidinesulphinic acid.

It is also known to perform the bleaching treatment using an oxidizing agent such as, for example, chlorine dioxide, peracetic acid, ozone and, above all, hydrogen peroxide.

The use of hydrosulfite and that of hydrogen peroxide is described, for example, by R. R. Kindron, Pulp & Paper, Nov. 1980, 54(11), 127–130.

The use of hydrosulfite generated from borohydride is described, for example, by John W. Gerrie, "Pulp & Paper Magazine of Canada", vol. 75, No. 7, July 1974, 89–92 and by Robert G. Guess, Pulp & Paper, June 1979, 53(6), 74–81.

The use of borohydride is described, for example, by V. Loras and N. Soteland, Norsk Skogindustri, 26(10), 1972, 255–258.

Lastly, it is known to perform the bleaching according to a process combining a bleaching treatment using an oxidizing agent and a bleaching treatment using a reducing agent, as described, for example, in the last of the abovementioned references.

In each case, the use of complexing or sequestering agents is regarded as necessary for counteracting the negative effect of the metals, such as iron or manganese, which are always present in the matter to be bleached in practice.

The use of such complexing or sequestering agents is described, for example, in German Patent Application DE-OS-3,308,298, in the paper by Robert G. Guess, already referred to, in that by P. Whiting, J. M. Pitcher and D. F. Manchester, Journal of Pulp & Paper Science, Sept. 1984, 10(5), J119–I126 and in that by J. Roger Hart, Pulp & Paper, June 1981, 138–140.

The complexing or sequestering agents which are employed are, for example, sodium tripolyphosphate, sodium tetrapyrophosphate, and diethylenetriaminepentacetic and ethylenediaminetetraacetic acids in the form of sodium salts.

The addition of the complexing or sequestering agents can take place either imultaneously with or before that of the bleaching agent. In the latter case the matter to be bleached is subjected to a pretreatment with the complexing or sequestering agent.

In the case of a bleaching treatment using an oxidizing agent such as hydrogen peroxide, the best results are achieved when the pretreatment with the complexing or sequestering agent ends with an intensive washing operation.

On the other hand, in the case of a bleaching treatment using a reducing agent, according to the state of the art the improvement in bleaching would be expected only in a process in which the complexing or sequestering agent necessarily accompanies the reducing agent in its action.

This follows, for example, from the work of V. Loras et al and from that of P. Whiting et al, referred to earlier, another lesson from which is that, in a process combining the action of a reducing bleaching agent, such as dithionite or borohydride, with that of an oxidizing bleaching agent such as hydrogen peroxide, the order of use of the two bleaching agents which produces the best results depends on the nature of the reducing agent chosen and cannot therefore be determined beforehand.

Also according to the nature of the reducing agent, the conditions, above all such as those of pH, in which this reactant becomes most effective may be essentially different: an acidic medium, for example, in the case of dithionite, and an alkaline medium, for example, in the case of borohydride.

Thus, until now, industry has not had the benefit of a process for bleaching lignocellulosic matter, as defined here, capable of combining the action of an oxidizing bleaching agent with that of a reducing bleaching agent in a way which is independent of the nature of the reducing agent.

SUMMARY OF THE INVENTION

The present invention not only provides a process of this kind but also, in its general scope, leads to bleaching effects which are superior to those achieved so far by the use of the known processes based on a combination of an oxidizing bleaching operation and a reducing bleaching operation.

The process of the invention is characterized in that, after pretreatment using at least one metal complexing or sequestering agent, the lignocellulosic matter undergoes a washing operation with an efficiency greater than 96% before undergoing in succession a bleaching treatment using a reducing agent at a pH of between 8 and 12, a washing operation to remove the reducing agent and a bleaching treatment using an oxidizing agent.

DETAILED DESCRIPTION

As used herein, a "washing operation" means the operation consisting in more or less completely removing from the lignocellulosic matter the liquid phase which it contains, for example by virtue of a concentration of the lignocellulosic matter, for example by pressing on a filter, or by virtue of a sequence, which may be repeated or not, of dilution, in most cases with water, followed by concentration of the lignocellulosic matter, for example by a filter pressing operation; and "Efficiency", expressed in percent, means the degree of removal of the liquid phase present in the lignocellulosic matter before washing.

The washing operation which follows the pretreatment of the lignocellulosic matter with the complexing or sequestering agent in the process of the invention is in most cases performed in practice by dilution of the lignocellulosic matter with water and concentration by a filter pressing operation, at a temperature which is generally between approximately 20° C. and 90° C., and frequently between approximately 20° C. and 60° C. for economic reasons.

In the pretreatment with the complexing or sequestering agent, the latter is employed in a proportion of approximately 0.1% to 1% by weight of the weight of lignocellulosic matter in dry form. Except where it is specified or obvious, throughout the following text, the quantities of reactant are also expressed as a weight percentage of the weight of the lignocellulosic matter in dry form.

The complexing or sequesterin agent is in most cases chosen from sodium tripolyphosphate, sodium tetrapyrophosphate, and sodium salts of acetic, nitrilotriacetic, ethylenediaminetetraacetic and diethylenetriaminepentaacetic acids.

In most cases, the pretreatment with the complexing or sequestering agent is performed at a temperature of between approximately 20° C. and 100° C., preferably between 50° C. and 95° C., in order to avoid having to work under pressure while maintaining a rate of complexing or sequestering which is sufficiently high.

The consistency, the percentage content of the treatment medium in the lignocellulosic matter in dry form, may be made equal in the pretreatment to a value which lies within fairly wide limits, approximately 5% to 50%, but in general it does not exceed approximately 25% in the case of the pulps and in most cases remains between 10% and 40% in the case of the chips, in order to reconcile economy and the efficiency of the subsequent washing operation. The duration depends on the other parameters and on the equipment employed. While it generally lies between approximately 5 minutes and 2 hours in the case of the pulps, it may be reduced to a few minutes and even some tens of seconds in the case of the chips as defined here.

The bleaching treatment which follows the washing operation with an efficiency greater than 96% is performed using a reducing agent chosen, in most cases, from sodium dithionite, thiourea dioxide and sodium borohydride.

The latter is advantageously employed in a proportion of approximately 0.05% to 0.7% in the presence of sodium hydroxide, for example in the form of approximately 0.4% to 6% of the alkaline solution of sodium borohydride containing 12% by weight of this material and marketed under the trade name of BOROL® by Ventron Corporation.

To exhibit its best activity within the required pH range, sodium dithionite is preferably employed in a proportion of approximately 1% to 10% with approximately 0.5% to 5% of sodium hydroxide and a quantity of sodium silicate corresponding to approximately 1% to 4% of an aqueous solution of this material with a relative density of 1.33, so that the weight ratio of sodium dithionite to sodium hydroxide is between approximately 1.5 and 2.5 and that the weight ratio of sodium silicate solution with a relative density of 1.33 to sodium hydroxide is between approximately 1 and 2.

With regard to thiourea dioxide, this is employed in a proportion of approximately 1% to 10% in the presence of approximately 0.5% to 5% of sodium hydroxide, still in order to implement the invention in a preferred manner.

In the reducing bleaching treatment, the consistency is mostly between approximately 5% and 50%, and in practice between approximately 5% and 25% in the case of pulps.

The reducing bleaching treatment is performed at a temperature of between approximately 30° C. and 90° C. and which is preferably between approximately 40° C. and 60° C., although its influence is relatively small in the selected range.

The reducing bleaching treatment generally lasts between 0.5 hour and 2 hours.

As is known, it may be performed at best in the absence of oxygen, especially atmospheric oxygen, in most cases by virtue of a nitrogen or steam atmosphere.

At the end of the bleaching treatment using the reducing agent, followed by a washing operation to remove the reducing agent and whose efficiency is advantageously greater than 96%, as in the case of the washing operation which follows the pretreatment, the treatment using the oxidizing agent is performed, the oxidizing agent being in the majority of cases chosen from chlorine dioxide, peracetic acid, ozone and hydrogen peroxide.

The invention makes it possible to dispense with a repeated use of a complexing or sequestering agent before or during the oxidizing bleaching, in contrast to the currently recommended, practice.

Apart from this particular feature, the oxidixing bleaching is preferably performed using hydrogen peroxide, employed, for example, in a proportion of approximately 0.5% to 10%, in the presence of sodium silicate, at a pH of between approximately 9 and 11, at a temperature between approximately 60° C. and 90° C., in most cases for approximately 0.5 hour to 2 hours with a consistency which is generally between approximately 15% and 30%.

The process of the invention may be performed in any equipment which combines units which are known in the papermaking industry to be suitable for the operations of pretreatment, washing and bleaching, such as, inter alia, mills, filters and presses.

Thus, it has been found that it is possible to perform it, completely or partially, in a machine for processing wood chips described in the Creusot-Loire patents which have already been mentioned.

A machine of this kind consists essentially of two interpenetrating spiral surfaces wound around parallel shafts driven in synchronous rotation in the same direction inside a barrel which encloses them, and determining between upstream and downstream in the direction of forward motion of the matter a series of zones for drawing and braking the matter.

The action of the complexing or sequestering agent on the chips which, depending on the type of pulp aimed at, has or has not been subjected to the action of a chemical reactant such as, for example, sulphite, then takes place in an astonishingly quick and effective manner. The same applies to the washing operation associated with this action.

The invention will be further described in the examples below, which are given by way of guidance and illustration only, without any limitation being implied, and which permit the advantage of the process of the invention to be assessed.

In these examples, the quantities of reactants which are employed are expressed in weight percentage of the weight of lignocellulosic matter in dry form, and the terms "washing" and "efficiency" have the meanings indicated above respectively, the term "sodium silicate" denotes a commercial solution of sodium silicate with a relative density of 1.33, the pH during the reducing bleaching is always between 9 and 12 and the degrees of whiteness of the pulps (457 nm) are measured as a percentage using a Karl Zeiss model Elrepho spectrophotometer.

EXAMPLE 1

10 g of stone groundwood pulp, a mechanical pulp of resinous wood, which contains 4 g of lignocellulosic matter in dry form and whose degree of whiteness is equal to 56.4% are adjusted to a consistency of 10% in order to be pretreated in a kneading mill using 0.5% of a solution containing 40% of the sodium salt of diethylenetriaminepentaacetic acid for 15 minutes at 90° C before undergoing a washing operation carried out by performing two dilutions of the pretreated pulp with a total quantity of 0.5 l of water, each dilution being followed by a concentration by pressing to a consistency of 35%, so that a washing efficiency of 99% is ensured.

The pulp produced in this manner is adjusted to a consistency of 15% in order to be bleached in a kneading mill under a nitrogen atmosphere using 1.25% of sodium dithionite in the presence of 0.75% of sodium hydroxide and 1% of sodium silicate, for 1 hour at a temperature of 90° C.

After being washed to remove the reducing agent, the pulp is bleached in a kneading mill to a consistency of 20% using 3% hydrogen peroxide in the presence of 1.5% of sodium hydroxide and 4% of sodium silicate for 2 hours at 90° C.

Finally, the pulp resulting from the above treatments has a degree of whiteness of 81%, while only 55% of the hydrogen peroxide employed has been consumed.

EXAMPLE 2 (COMPARATIVE)

Example 1 is repeated, with the operation of washing the pulp after the pretreatment being omitted.

The pulp which is finally obtained has a degree of whiteness which is now only 78%, while the usage of hydrogen peroxide is 1.4 times as high as in Example 1.

EXAMPLE 3

Example 1 is repeated, with the exception that the quantities of reactants employed in the reducing bleaching are 5% of sodium dithionite, 2% of sodium hydroxide and 3% of silicate.

The degree of whiteness which is finally obtained is 83% for a hydrogen peroxide consumption which is only 56% of the hydrogen peroxide employed.

EXAMPLE 4

10 g of the pulp of Example 1, adjusted to a consistency of 10% in order to be pretreated as in Example 1, are washed after pretreatment so that the washing efficiency reaches 97%, before being subjected, in a kneading mill under a nitrogen atmosphere and at a consistency of 15%, to the action of 1.25% of thiourea dioxide in the presence of 0.8% of sodium hydroxide for 40 minutes at a temperature of 90° C.

The pulp is then washed to remove the reducing agent and is then bleached in a kneading mill for 2 hours at 90° C. at a consistency of 20%, using 10% of hydrogen peroxide, in the presence of 3% of sodium hydroxide and 4% of sodium silicate.

The bleached pulp obtained has a degree of whiteness which is excellent, since it is 89%, while only 40% of the hydrogen peroxide employed has been consumed.

EXAMPLE 5

When the quantities of thiourea dioxide and sodium hydroxide in Example 4 are doubled but when only 1% of hydrogen peroxide accompanied by 0.5% of sodium hydroxide and 2% of sodium silicate are employed during the oxidizing bleaching process, because of the bleachability acquired during the process of the invention, at the end of the latter the pulp has a degree of whiteness of 82%, obtained with a usage of hydrogen peroxide of 64% of the hydrogen peroxide employed.

EXAMPLE 6

10 g of a conifer stone groundwood pulp manufactured in a machine of the type of that described in the French patents published under Nos. 2,436,844 and 2,451,963 respectively, which has a degree of whiteness of 53.7% and contains 4 g of lignocellulosic matter in dry form, are adjusted to a consistency of 10% for pretreatment and are then washed like the groundwood pulp in Example 1.

The bleaching treatment is then performed on the pretreated and washed pulp adjusted to a consistency of 20% in a kneading mill under a nitrogen atmosphere, using 5% of BOROL® in the presence of 5% of sodium silicate, for 1 hour at a temperature of 50° C.

After washing to remove the reducing agent, the oxidizing bleaching process is finally performed at a consistency of 20%, using 3% of hydrogen peroxide, 1.5% of sodium hydroxide and 4% of sodium silicate for 2 hours at a temperature of 90° C.

The degree of whiteness of the pulp bleached in this manner attains a value of 85.3% for a usage of 53.2% of the quantity of hydrogen peroxide employed.

EXAMPLE 7

600 kg/h of resinous wood chips which contain 40% of vegetable matter in dry form and which produce a mechanical pulp with a degree of whiteness of 54% after merely mechanical grinding, are added continuously into a first machine of the type of that described in the abovementioned Creusot-Loire patents, equipped with orifices for adding reactants or washing liquids such as water to the drawing zones and with filtering sections as indicated, for example, in the French patent published under No. 2,451,963.

The pretreatment, using 0.5% of a 40% strength solution of the sodium salt of diethylenetriaminepentaacetic acid takes place on average for 1 minute in the first drawing zone and in the first braking zone at a temperature of 85° C., at which temperature, furthermore, the whole process is carried out.

Water is added downstream of the first braking zone so as to perform the washing operation in the second drawing zone with a consistency of 10%.

The removal of the liquid expelled by compression of the pulp as far as the second braking zone raises the consistency to a value of 40% downstream of this zone when water is once again added to adjust the consistency to a value of 10% in the third drawing zone.

The removal of the liquid expelled by compression of the pulp as far as the third braking zone raises the consistency to a value of 40% downstream of this zone when 5% of sodium dithionite, 2% of sodium hydroxide nd 3.5% of sodium silicate are added with water in order to perform the reducing bleaching process in the fourth drawing zone and the fourth braking zone at a consistency of 35%.

At the outlet of the first machine the pulp is kept for 1 hour at the same consistency in a storage tank under a steam atmosphere before being introduced into a second machine of the same design as the first, where the reducing agent is removed by dilution, compression and filtration in the first three sections of the machine, each section consisting of a matter-drawing zone and a matter-braking zone.

The oxidizing bleaching process takes place in the fourth section of the machine and then in a storage tank during a residence time of 1 hour, at a consistency of 25%, using 4.7% of hydrogen peroxide, 2% of sodium hydroxide, 4% of sodium silicate and 0.1% of a 40% strength solution of the sodium salt of diethylenetriaminepentaacetic acid, which are added into the fourth drawing zone.

Finally, the pulp travels to a twin-disk refiner and has a degree of whiteness of 78.5%.

EXAMPLE 8 (COMPARATIVE)

Example 7 is repeated, the washing operation after pretreatment in the first machine being omitted.

The degree of whiteness of the pulp which is ultimately obtained is then only 76.5%.

EXAMPLE 9

10 g of a sulphite chemicothermomechanical pulp, of resinous wood, of a type of pulp which is reputed to be difficult to bleach, which contain 4 g of lignocellulosic matter in dry form and which have a degree of whiteness of 46%, are adjusted to a consistency of 10% in order to be pretreated and washed after pretreatment like the stone groundwood pulp in Example 1.

The pulp which has thus been pretreated and washed in a highly efficient manner is subjected to a reducing bleaching treatment using 5% of sodium dithionite in the presence of 2% of sodium hydroxide and 3% of sodium silicate for 1 hour at 90° C. in a kneading mill under a nitrogen atmosphere, at a consistency of 15%.

After being washed to remove the reducing agent, the pulp is then treated in the kneading mill using 2% hydrogen peroxide in the presence of 1% of sodium hydroxide and 3% of sodium silicate, at a consistency of 20%, for 2 hours at 90° C.

The bleached pulp obtained as a degree of whiteness of 72%, while 75% of the hydrogen peroxide employed is consumed.

EXAMPLE 10 (COMPARATIVE)

Example 9 is repeated, except that the reducing bleaching treatment follows the pretreatment without any washing of the pretreated pulp.

The bleached pulp ultimately obtained has a degree of whiteness of only 67% at a high hydrogen peroxide usage which reached 95% of the quantity employed.

The mechanical properties of the bleached pulp in this example are also inferior to those of the pulp bleached according to the invention. For example, the breaking length is 1.25 times as high with the procedure according to Example 9 as with the procedure according to Example 10.

EXAMPLE 11

When the procedure followed is as in Example 9, and thus ensures, in particular, a highly efficient washing of the pulp between the pretreatment and the reducing bleaching process, but finishes with a bleaching operation using 10% of hydrogen peroxide, 3% of sodium hydroxide and 4% of sodium silicate, the degree of whiteness of the chemicothermomechanical bleached pulp obtained attains 80%, while 75% of the quantity of hydrogen peroxide employed is converted.

Thus, the process according to the invention offers a general method for producing bleached mechanical type pulps, of high degree of whiteness, between 25% and 35% (on an absolute scale) higher than the degree of whiteness of the original unbleached pulps, at the sacrifice, in view of this strong bleaching action, only of a reduced usage of an oxidizing bleaching agent such as hydrogen peroxide.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

We claim:

1. A process for bleaching a lignoscellulosic matter in the form of a mechanical, thermomechanical, chemicomechanical or chemicothermomechanical papermaking pulp, or of wood chips while being converted into one of these pulp types which comprises in sequence, pretreating the lignocellulosic matter with at least one metal-complexing or sequestering agent, bleaching said lignocellulosic matter with a bleaching treatment using a reducing agent at a pH of between 8 and 12, washing to remove said reducing agent, and bleaching with a bleaching treatment using an oxidizing agent, characterized in that, after pretreatment, the lignocellulosic matter undergoes a washing operation with an efficiency greater than 96% before undergoing in succession said bleaching treatment using a reducing agent, said washing operation to remove the reducing agent and said bleaching treatment using an oxidizing agent.

2. The process according to claim 1 wherein the washing operation after pretreatment is performed at a temperature of between about 20° C. and 90° C.

3. The process of claim 2 wherein the washing operation after pretreatment is performed, in sequence by dilution with water and concentration by filter pressing.

4. The process of claim 3 wherein the complexing or sequestering agent comprises sodium tripolyphosphate, sodium tetrapyrophosphate, or the sodium salts of citric, nitrilotriacetic, ethylenediaminetetraacetic and diethylenetriaminepentaacetic acids.

5. The process of claim 4 wherein the complexing or sequestering agent is employed in a proportion of about 0.1% to 1%.

6. The process of claim 5 wherein the pretreatment is performed at a temperature of between about 20° C. and 100° C., the consistency being between about 5% and 50%.

7. The process of claim 6 wherein the bleaching treatment using the reducing agent is performed at a temperature of between about 30° C. and 90° C., the consistency of the lignocellulosic matter being from about 5% to 50%.

8. The process of claim 7 wherein the reducing bleaching treatment is performed by adding to the lignocellulosic matter sodium dithionite in a proportion of about 1% to 10%, in the presence of about 0.5% to 5% of sodium hydroxide and about 1% to 4% of an aqueous solution of sodium silicate with relative density of 1.33, so that the weight ratio of sodium dithionite to sodium hydroxide is between about 1.5 and 2.5 and that the weight ratio of the sodium silicate solution with a relative density of 1.33 to sodium hydroxide is between about 1 and 2.

9. The process of claim 7 wherein the reducing bleaching treatment is performed by adding to the lignocellulosic matter thiourea dioxide in a proportion of about 1% to 10% in the presence of about 0.5% to 5% of sodium hydroxide.

10. The process of claim 7 wherein the reducing bleaching treatment is performed by adding to the lignocellulosic matter sodium borohydride in a proportion of 0.05% to 0.7% in the presence of sodium hydroxide.

11. The process of any one of claims 1 to 10 wherein the oxidizing bleaching treatment is performed using an oxidizing agent selected from chlorine dioxide, peracetic acid, ozone, or hydrogen peroxide.

12. The process of any one of claims 1 to 10 wherein the bleaching treatment using the oxidizing agent is performed at a pH of between about 9 and 11, the consistency being between about 15% and 30%, using 0.5% to 10% of hydrogen peroxide in the presence of sodium silicate.

* * * * *